United States Patent [19]

Bostwick

[11] 4,145,183

[45] Mar. 20, 1979

[54] METHOD FOR THE OXIDATIVE TREATMENT OF TEXTILES WITH ACTIVATED PEROXYGEN COMPOUNDS

[75] Inventor: Joseph H. Bostwick, Wilmington, Del.

[73] Assignee: E. I. Du Pont de Nemours and Company, Wilmington, Del.

[21] Appl. No.: 850,671

[22] Filed: Nov. 11, 1977

Related U.S. Application Data

[63] Continuation-in-part of Ser. No. 642,235, Dec. 19, 1975, abandoned.

[51] Int. Cl.[2] ..... D06L 3/02

[52] U.S. Cl. ..... 8/111; 134/26; 134/28; 134/38; 134/39; 134/40; 252/94; 252/102; 252/186; 427/301; 427/322; 427/324

[58] Field of Search ..... 427/337, 301, 400, 444, 427/324, 394, 341, 342; 252/102, 94, 186; 134/26, 38, 28, 39, 40; 8/111

[56] References Cited

U.S. PATENT DOCUMENTS

| | | | |
|---|---|---|---|
| 1,940,768 | 12/1933 | Popkin | 8/111 |
| 2,077,103 | 4/1937 | Franz | 8/111 |
| 2,134,898 | 11/1938 | Van Allen | 8/111 |
| 2,267,276 | 12/1941 | Hager | 427/342 |
| 3,583,924 | 6/1971 | Demangcon et al. | 252/102 |
| 3,632,295 | 11/1972 | Hall et al. | 8/111 |
| 3,775,333 | 11/1973 | Loffelman | 252/102 |
| 3,784,400 | 1/1974 | Cassella | 427/337 |
| 3,886,078 | 5/1975 | Loffelman | 252/102 |
| 3,907,698 | 9/1975 | Loffelman et al. | 252/102 |
| 3,925,234 | 12/1975 | Hachman et al. | 252/102 |

*Primary Examiner*—Ronald H. Smith
*Assistant Examiner*—Janyce A. Bell

[57] ABSTRACT

The efficacy of the oxidative treatment of textile fabric surfaces with activated peroxygen compounds is improved by (1) coating the surface, particularly the stains thereon, with an adherent layer of a viscous anhydrous composition comprising a peroxide activator dispersed in water-soluble nonionic surfactant and (2) immersing the coated fabric in water containing activatable peroxygen compounds until the layer has disintegrated.

11 Claims, No Drawings

METHOD FOR THE OXIDATIVE TREATMENT OF TEXTILES WITH ACTIVATED PEROXYGEN COMPOUNDS

CROSS-REFERENCE TO RELATED APPLICATIONS

This application is a continuation-in-part of copending application Ser. No. 642,235, filed Dec. 19, 1975, now abandoned.

BACKGROUND OF THE INVENTION

The invention is directed broadly to a method and composition for treating the surface of textiles oxidatively using activated peroxygen compounds. More particularly, it is directed to a method and composition for reducing or removing stains from textiles oxidatively using activated peroxygen compounds.

Probably the most frequent need for effective oxidative action upon surfaces arises when textiles become undesirably stained in some manner. It is, of course, well known that many stains, especially those of household origin, can be bleached effectively by application thereto of oxidizing agents.

Many bleaching agents have been used for household applications, of which the chlorine-containing bleaches are most widely used at the present time. However, chlorine bleach has the serious disadvantage of being such a powerful bleaching agent that it causes measurable degradation of the fabric and can cause localized over-bleaching. Other active chlorine bleaches, such as chlorinated cyanuric acid, although somewhat safer than sodium hypochlorite, also suffer from a tendency to damage fabric and cause localized over-bleaching. For these reasons, chlorine bleaches can seldom be used on amide-containing fibers such as nylon, silk, wool and mohair. Furthermore, chlorine bleaches are particularly damaging to many flame retardant agents which they render ineffective after as little as five launderings.

For several reasons, peroxygen bleaching agents are widely employed in the textile industry for removal or reduction of undesirable natural color bodies from new fabrics, yarns and fibrous materials. Peroxygen bleaching agents are not only highly effective in whitening fabrics and removing stains, but they are also safer to use on colors. They do not attack fluorescent dyes and fabrics to any serious degree and they do not cause yellowing of resin finishes. However, because peroxides react slowly with many color bodies, they must frequently be applied at severe conditions of temperature and alkalinity.

Because many home laundering facilities, particularly in the U.S., employ quite moderate wash water temperatures (20°-60° C.), low alkalinity and short soaking times, peroxygen bleaches when used in such systems have heretofore been capable of only mild bleaching action.

Much effort has been expanded to improve the effectiveness of peroxides. The major thrust of this effort has been in the use of activators, that is, compounds which will convert a peroxygen compound dispersed in water to a more active oxidative form. Literally thousands of activators have been proposed and their effects demonstrated on a variety of stains and fabrics. However, the use of such materials in home laundry systems has been limited because of the problems associated with (1) formation and stability of the activated compound and (2) the stoichiometry of the reaction system.

To illustrate this point, the better noncatalytic activators perform well only when they are used in approximately stoichiometric amounts and preferably in stoichiometric excess, basis active oxygen in the bleaching or stain removal system. This situation presents a serious practical problem in that a dry laundry detergent composition containing both activator and peroxygen compound would have to be totally anhydrous and would have to be packaged and stored to prevent deactivation by reaction with atmospheric moisture. Furthermore, because the catalytic activators act instantaneously in water to decompose hydrogen peroxide, they can not be packaged with the peroxide and must be added separately to the wash water.

Both types of activators suffer from the disadvantage that a substantial proportion of the activated species is formed away from the surface where it is needed and that much of the effective species may be depleted before it comes into contact with the surface where the oxidative action is required. Thus, gross concentrations of peroxygen compound and correspondingly higher amounts of activator are required to offset this effect in conventional laundry systems. Notwithstanding the use of very high concentrations, conventional bleaching systems of this type have been largely inadequate in the removal of stains from polyester/cotton blends finished with crease resistant or durable press resins. This type of fabric is well known for its tenacious retention of stains, a property which is magnified by the use of low- or no-phosphate wash liquors.

BRIEF DESCRIPTION OF THE INVENTION

The invention is therefore directed to an improved method of treating textile fabric surfaces oxidatively using activated peroxygen compounds and to compositions useful in this method. More particularly, the invention is directed in one aspect to a method for treating the surface of a textile fabric oxidatively using activated peroxygen compounds comprising (1) coating the surface with an adherent layer of a viscous water-soluble composition comprising
  (a) a peroxide activator dispersed in
  (b) a nonionic surfactant having an HLB number below about 30, the weight ratio of activator to surfactant in the composition being from about 1:10 to about 10:1; and
(2) immersing the coated fabric in water containing at least 5 ppm by weight, basis active oxygen, of peroxygen compound until the layer of water-soluble composition has disintegrated.

In a second aspect, the invention is directed to a viscous, anhydrous water-soluble composition for preparing the surface of a textile fabric for oxidative treatment with activated peroxygen compound dispersed in water comprising (a) a peroxide activator dispersed in
(b) a nonionic water-soluble surfactant having an HLB number below about 30, the weight ratio of activator to surfactant in the composition being from about 1:10 to about 10:1.

DEFINITIONS

The term "peroxygen compound," as used herein, refers to hydrogen peroxide, alkali metal perborate, percarbonate, perphosphate, persilicate, perpyrophosphate, peroxides and mixtures thereof.

By "activated peroxygen compound" is meant active oxygen-containing compounds produced by reaction of a noncatalytic activator with peroxygen compound.

The term "activator" refers to any material which will co-react at low temperatures with peroxygen compounds contained in an aqueous medium to form an activated peroxygen compound.

DETAILED DESCRIPTION OF THE INVENTION

The method of the invention provides a more effective means of effecting oxidative reactions with peroxygen compounds in that activated peroxygen compounds are formed in situ on a fabric surface where coated as soon as the coating comes into contact with the aqueous solution of peroxygen compound. Furthermore, such activated compounds continue to be formed at the coated surface as the coating disintegrates. As the water-soluble surfactant is dissolved in the water, more activator is exposed to the water containing the peroxygen compound and activated peroxygen compound is formed at the exposed surface.

The coating composition which is used in the method of the invention is formulated as a semi-solid or solid in the form of a solid cake which is sufficiently sticky to adhere to the fabric surface and can be applied by rubbing it over the surface to be treated. Thus, the precise mechanism of adhesion is not important so long as the composition is sufficiently adherent to the fabric to be treated to remain there, upon immersion of the fabric, until the composition is disintegrated by dissolving out the surfactant.

Though it is essential that the surfactant be water-soluble, a wide variety of nonionic surfactants are useful in the practice of the invention. Nonionic surfactants are preferred because they tend to be more compatible with the activators with which they are formulated. Surfactants having an hydrophile-lypophile balance (HLB) number of from 5 through about 30 have been found to be particularly effective with HLB numbers of 9–16 being preferred. Surfactants with HLB numbers below about 5 tend to be insufficiently soluble in water to function well in the coating composition and those with HLB numbers above about 30 tend to have too much free acid and thus present problems of compatibility with the activator.

Because the surfactant functions as a binder for the activator as well as a fabric surface activator, the nonionic surfactant must also have a viscosity suitable for application to the fabric. Since a convenient way of applying the composition is to apply it by rubbing the stained fabric with a shaped solid stick of the composition in much the same manner as lipstick and stick deodorants are used on the skin, the compositions of soft consistency will have Brookfield viscosities of as low as 4–5,000 cps. On the other hand, they can be formulated to fairly hard consistencies having penetration values (ASTM D-1937-58) as low as 5 dmm at 77° F. By way of comparison, petrolatum (petroleum jelly) ranges in penetration from about 40 to about 300 dmm.

In general, it will be prepared for the sake of simplicity to select a nonionic surfactant which, when mixed with the activator in the desired ratios, will yield the desired consistency. However, it will be recognized that suitable thickening agents can be used so long as the resultant thickened composition can be broken down by contact with water at 20°–60° C.

As mentioned above, it is essential that the surfactant be sufficiently water-soluble that it is dissolved in the water and diffused away from the coated surface, thus exposing the activator to the peroxygen compound in the water.

In addition, it is preferred for reasons of storage stability of the composition that the composition and components thereof be anhydrous or nearly so.

The coating composition comprising nonionic surfactant and activator may be either homogenous or heterogenous in nature depending upon the melting point of the activator and its solubility in the surfactant. Again, for reasons of stability, it is preferred that the surfactant constitute a continuous phase in which the activator is dispersed as a discontinuous phase.

The weight ratio of activator to surfactant (A/S) is not critical. However, for more efficient use of the activator and surfactant, it is preferred that A/S be between about 1:10 and 10:1. Below about 1:10 the amount of coating used to apply a given amount of activator becomes excessive. Above about 10:1, it may become increasingly difficult to formulate the activator as a discontinuous phase. Ratios of from 1:5 to 5:1 are most preferred.

As will be evident to one skilled in the surfactant art, there are literally hundreds of suitable nonionic surfactants and dozens of suitable classes of surfactants which, upon selection as to viscosity, water-solubility, volatility and HLB number, can be used as binders for the activator in the coating compositions of the invention.

Nonionic surfactants, which are preferred in the practice of the invention, are those surface active compounds which contain an organic hydrophilic group and a hydrophobic group which is a reaction product of a solubilizing group such as carboxylate, hydroxyl, amido or amino with ethylene oxide or with the polyhydration product thereof, polyethylene glycol.

Examples of nonionic surface active agents include condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate and the condensation products of polypropylene glycol with ethylene oxide and block copolymers containing hydrophilic poly(oxyethylene) groups and hydrophobic poly(oxypropylene) groups.

As noted above in the definitions, the activators which are useful in practicing the invention function noncatalytically. In particular, the activator co-reacts with peroxygen compound to form an activated peroxygen compound.

Most noncatalytic activators, of which there are hundreds, function by coreaction with the peroxygen compound to form peracids or salts thereof which react more rapidly with oxidizable compounds than the peroxygen compound itself. These compounds are usually acyl compounds. In the present invention organic acid anhydrides are particularly preferred. The following types of activators have been reported:

| | |
|---|---|
| $C_{2-9}$ N-acyl or O-acyl compounds | U.K. Patent 972,109 |
| Carboxylic acid esters | U.S. 2,955,905 |
| | U.K. Patent 836,988 |

-continued

| | |
|---|---|
| Organic acid anhydrides | U.S. 2,284,477<br>U.S. 2,362,401<br>U.S. 2,338,839 |
| Acyl amides | U.S. 3,637,339<br>U.S. 3,177,148<br>U.S. 2,898,181 |
| N-diacylated alkylene diamines | U.S. 3,163,606 |
| N-acetyl amides | U.S. 3,163,603 |
| Acyl imides | U.S. 3,061,550<br>U.S. 3,163,606 |
| Aldehydes and lactones | U.S. 3,822,114 |
| N-acyl azolinones | U.S. 3,775,333 |
| Acylated glycoluril | U.S. 3,715,184 |
| 1-Substituted-3-acylhydantoin | U.S. 3,349,035 |
| N,N'-diacyl-methylene-diformamides | U.S. 3,425,786 |
| Phenolic esters of α-chloro-lower aliphatic carboxylic acids | U.S. 3,130,165 |
| Acetylated alkyl phosphate esters | U.S. 3,073,666 |
| N-benzoylsaccharin | U.S. 3,886,078 |
| N-acylamidazoles | Fine et al., Soap Cosmet., Chem. Spec., 1974, pp 42–57 |
| Mixture of acetic acid esters of mono- or di-saccharide and polyhydric alcohol | U.S. 3,901,819 |

Many of the activators will be solids which are insoluble in the water-soluble surfactant at room temperature. However, within the broad functional limits discussed hereinabove, they can also be liquids, which can be dispersed in a solid nonionic surfactant. Furthermore, solubility or insolubility of the activator in the surfactant is not a primary factor in their desirability for use in the invention whether liquid or solid activators are used.

Peroxygen compounds which are useful in the invention are hydrogen peroxide, alkali metal perborate, percarbonate, perphosphate, persilicate, perpyrophosphate, peroxides and mixtures thereof. Hydrogen peroxide, sodium perborate and sodium percarbonate are preferred peroxygen compounds. To obtain a significant degree of oxidative action, it is necessary that the water into which the coated textile surface is immersed contain at least 5 ppm by weight peroxygen compounds, basis active oxygen. The upper limit of active oxygen is, of course, not critical; however, there will usually be no economic justification for using more than about 1,000 ppm. In household lanudry applications of the method of the invention, it is preferred to use peroxygen compounds in concentrations equivalent to 10–100 ppm by weight active oxygen.

Although the nonionic surfactant and activator are essential components of the coating composition and the peroxygen compound is an essential ingredient of the water into which the coated textile surface is immersed, it will be recognized that either or both the coating composition and the water can contain other additives such as builders, enzymes, odorants, coloring agents, fillers, abrasives, antiseptics, optical brighteners, thickening agents and softening agents. However, it will be recognized that such optional additives must not interfere with either the chemical or physical functions of the peroxygen compound, activator and surfactant.

It will be apparent to those skilled in the art that the immersion step of the invention is primarily directed to the function of dissolving the nonionic surfactant and providing peroxygen compound at the coated textile surface for reaction with activator. So long as these functional criteria are met, the precise manner of the immersion is not critical. For example, the coated surface can be dipped into the water or the coated surface can be inundated with water. Agitation of either the water or the surface will, of course, facilitate diffusion of surfactant from the surface and diffusion of peroxygen compounds to the surface being treated oxidatively.

The invention is illustrated graphically by the examples which follow.

Preparation of Stained Swatches

Tea-stained swatches were prepared by dissolving the contents of a 2-ounce jar of Nestea ®[1] and 6 grams of Triton ® X-100 wetting agent[2] to the tub of an automatic washing machine containing 16 gallons of water at 57° C. The solution was agitated for 5 minutes to assure complete solution.

[1]Nestea, registered trade name of Nestle Co., Inc., White Plains, NY, for solid tea extract.

[2]Triton, registered trade name of Rohm & Haas Company, Philadelphia, PA, for alkylacyl polyether alcohol, sulfonate and sulfate based surfactants.

Fifty 9" × 9" swatches of a Dacron ®[3]/cotton fabric[4] were placed in the tub of the washer and the filled tub was agitated for another 5 minutes. The swatches were then allowed to soak in the solution for 90 minutes without agitation. At the end of the soaking time, the contents of the tub were taken through a 14-minute wash cycle followed by cold water rinse and spin cycles. The spin-dried swatches were then removed from the washer tub and tumble-dried in hot air (exhaust temperature 66° C.) for 30 minutes to set the stains in the fabric.

[3]Dacron, registered trade name of E. I. du Pont de Nemours & Co., Inc., Wilmington, DEL, for polyester fiber.

[4]Fabric Style 7406 WRL, Dacron 54W/Cotton, 65/35, with durable press finish from Test Fabrics, Inc., Middlesex, NJ.

Grape-stained swatches were prepared by the following procedure:

A concentrated staining solution was made by diluting a 40-ounce bottle of Welch's grape juice to 3.0 liters, adjusting pH to 7.0 with sodium carbonate and adding 0.3 gram Triton X-100. Fifty 9" × 9" swatches of a Dacron/cotton fabric were added one at a time to a 4 liter beaker containing the concentrated stain. The swatches were soaked for 15 minutes while agitating, lifting and squeezing. Sixty ml of a 20% sodium chloride solution were added and soaking and agitating were continued for an additional 15 minutes. At this point, the swatches and staining solution were placed in the tub of an automatic washing machine containing 16 gallons of water at 57° C. and the tub contents were agitated for 5 minutes. The swatches were then allowed to soak for 30 minutes without agitation. At the end of the soak period, the contents of the tub were taken through a 14-minute wash cycle followed by cold water rinse and spin-drying cycles. The spin-dried swatches were then removed from the washer tub and tumble-dried in hot air (exhaust temperature 66° C.) for 30 minutes to set the stain.

Experimental Apparatus

The following equipment was used in carrying out the procedures described in the Examples which follow:

A. Model 7243 Tergotometer ®, registered trade name of the U.S. Testing Co., Inc., Hoboken, NJ:

A controlled agitation device comprising a series of four agitated stainless steel bowls immersed in a common temperature-controlled water bath. Each bowl is agitated by a three-vaned oscillating paddle similar to the agitator in a home washing machine. Capacity of each of the bowls is about two liters. The agitation is constant at 100 cycles per minute (cpm).

B. Hunterlab D-40 Reflectometer for Whiteness, made by Hunter Associates Laboratory, Inc., Fairfax, VA.

(Using blue filter and excluding reflected ultraviolet light).

As used herein, the term "% stain removal" refers to the ratio of reflectance (R) gained by the treatment to the reflectance lost by the staining and is computed as follows: 100 times the ratio of (R of treated stained surface — R of untreated stained surface) to (R of unstained surface — R of untreated stained surface).

EXAMPLE I

A series of tests was conducted in which coating compositions comprising a solid water-soluble anhydrous surfactant having dispersed therein an activator was applied by rubbing onto about one-third the area of a dry tea-stained fabric swatch and the coated fabric was immersed in the bowl of a Tergotometer ® containing 1000 ml of 49° C. water having dissolved therein 25 ppm hydrogen peroxide (basis weight of active oxygen) and 1.5 grams of Tide ®[5], formulated to be phosphate-free and a commercially available detergent for household use. In this series of tests, as well as the other Tergotometer ® tests reported hereinbelow, following the specified immersion time, the washed swatches were removed from the bowl, placed in a one-liter beaker and rinsed by submerging them under running tap water (cold) and repeatedly squeezing them by hand until sudsing was no longer apparent. Upon completion of the above-described procedure, the 4½" × 9" fabric swatch (cut from the above-described 9" × 9" swatches) was air dried and the reflectance of the treated area of the swatch measured. From previously measured reflectance values of the unstained fabric and the stained fabric without treatment, the percent stain removal was determined as described above.

[5]Tide, Trade name of Procter & Gamble, Cincinnati, Ohio, for granular household laundry detergent.

Solid sticks of the coating composition were prepared by blending molten surfactant at 40–80° C. with finely ground activator and then allowing the suspension to solidify by cooling to room temperature.

A series of comparative tests was conducted in which a coating consisting only of solid water-soluble anhydrous surfactant and containing no activator was applied and tested in the same manner.

A still further series of tests was conducted in which the uncoated fabric was immersed in the water simultaneously with a measured amount of activator. In addition, a control test was carried out in which neither activator nor surfactant was used in any way.

The results of the above-described tests are given in Table 1 below.

TABLE 1

Tergotometer ® Evaluation of Activators and Surfactants On Tea-Stained Fabric

Test Conditions:

Peroxygen compound $H_2O_2$, 25 ppm, basis active oxygen, 49° C. water temperature, 10 minutes wash at 100 cpm, 1.5 gms Tide ® (zero phosphate) in 1000 ml of water containing 150 ppm $CaCO_3$ hardness.

| | Coating Composition | | | | | | |
|---|---|---|---|---|---|---|---|
| Test No. | Surfactant | Activator | Wt. Ratio of Activator to Surfactant | Amount Applied (grams) | Applied to | Mole Ratio of Activator to $H_2O_2$ | % Stain Removal |
| 1 | None | None | — | — | — | — | 6.1 |
| 2 | Polystik[1] | — | 0.0 | 0.15 | Fabric | 0.0 | 3.4 |
| 3 | " | — | 0.0 | 0.23 | " | 0.0 | 7.2 |
| 4 | " | — | 0.0 | 0.46 | " | 0.0 | 6.0 |
| 5 | " | — | 0.0 | 1.15 | " | 0.0 | 6.8 |
| 6 | " | Phthalic Anhydride | 3.0 | 0.08 | " | 0.25 | 18.7 |
| 7 | " | " | 3.0 | 0.15 | " | 0.50 | 26.8 |
| 8 | " | " | 3.0 | 0.31 | " | 1.0 | 40.3 |
| 9 | " | " | 1.0 | 0.12 | " | 0.25 | 35.3 |
| 10 | " | " | 1.0 | 0.23 | " | 0.50 | 33.8 |
| 11 | " | " | 1.0 | 0.46 | " | 1.0 | 46.4 |
| 12 | " | " | 0.33 | 0.23 | " | 0.25 | 33.6 |
| 13 | " | " | 0.33 | 0.46 | " | 0.50 | 36.5 |
| 14 | " | " | 0.33 | 0.92 | " | 1.0 | 46.9 |
| 15 | " | " | 0.11 | 0.58 | " | 0.25 | 30.1 |
| 16 | " | " | 0.11 | 1.15 | " | 0.50 | 42.1 |
| 17 | " | " | 0.11 | 2.30 | " | 1.0 | 41.9 |
| 18 | None | " | ∞ | 0.115 | Bowl | 0.50 | 15.5 |
| 19 | " | " | ∞ | 0.230 | " | 1.0 | 27.4 |
| 20 | " | " | ∞ | 0.345 | " | 1.5 | 42.9 |
| 21 | " | " | ∞ | 0.460 | " | 2.0 | 45.0 |
| 22 | " | " | ∞ | 0.690 | " | 3.0 | 35.6 |

[1]Trade name of Purex Corporation, Lakewood, CA, for prewash stain remover (nonionic solid surfactant in stick form).

The above data show that when solid water-soluble surfactant alone is coated on the stained fabric, less than 7% stain removal can be realized at 25 ppm active oxygen and 49° C. water temperature, even when quite high amounts of surfactant are applied. On the other hand, when 25 to 75% of the surfactant is replaced by activator, an almost seven-fold increase in stain removal was obtained. It is interesting to note that neither very high nor very low ratios of activator to surfactant were as effective as intermediate ratios. The addition of activator directly to the bowl was much less effective for stain removal than addition to the fabric in combination with surfactant and required at least twice as much activator, relative to the peroxide, to reach the same degree of stain removal.

EXAMPLE II

A further series of Tergotometer tests were run in the same manner as Example I, except that the amount of active oxygen in the wash water was increased to 50 ppm. The results of this latter series of tests are given in Table 2 below.

TABLE 2

Tergotometer ® Evaluation of Activators and Surfactants On Tea-Stained Fabric

Test Conditions:

Peroxygen compound $H_2O_2$, 50 ppm, basis active oxygen, 49° C. water temperature, 10 minutes wash at 100 cpm, 1.5 gms Tide (No phosphate) in 1000 ml water containing 150 ppm $CaCO_3$ hardness.

| | Coating Composition | | | | | | |
|---|---|---|---|---|---|---|---|
| Test No. | Surfactant | Activator | Wt. Ratio of Activator to Surfactant | Amount Applied (grams) | Applied to | Mole Ratio of Activator to $H_2O_2$ | % Stain Removal |
| 23 | None | None | — | — | — | — | 19.3 |
| 24 | Polystik ® | — | 0.0 | 0.31 | Fabric | 0.0 | 14.3 |
| 25 | " | — | 0.0 | 0.46 | " | 0.0 | 14.7 |
| 26 | " | — | 0.0 | 0.92 | " | 0.0 | 20.0 |
| 27 | " | — | 0.0 | 2.30 | " | 0.0 | 18.0 |
| 28 | " | Phthalic Anhydride | 3.0 | 0.15 | " | 0.25 | 36.9 |
| 29 | " | " | 3.0 | 0.31 | " | 0.50 | 57.5 |
| 30 | " | " | 3.0 | 0.61 | " | 1.0 | 68.0 |
| 31 | " | " | 1.0 | 0.23 | " | 0.25 | 51.3 |
| 32 | " | " | 1.0 | 0.46 | " | 0.50 | 57.4 |
| 33 | " | " | 1.0 | 0.92 | " | 1.0 | 69.7 |
| 34 | " | " | 0.33 | 0.46 | " | 0.25 | 55.3 |
| 35 | " | " | 0.33 | 0.92 | " | 0.50 | 58.6 |
| 36 | " | " | 0.33 | 1.84 | " | 1.0 | 74.4 |
| 37 | " | " | 0.11 | 1.15 | " | 0.25 | 48.4 |
| 38 | " | " | 0.11 | 2.30 | " | 0.50 | 56.5 |
| 39 | " | " | 0.11 | 4.60 | " | 1.0 | 69.4 |
| 40 | None | " | ∞ | 0.23 | Bowl | 0.5 | 24.7 |
| 41 | | " | ∞ | 0.46 | " | 1.0 | 46.0 |
| 42 | | " | ∞ | 0.69 | " | 1.5 | 60.4 |
| 43 | | " | ∞ | 0.92 | " | 2.0 | 48.9 |
| 44 | | " | ∞ | 1.38 | " | 3.0 | 59.0 |

The above data show that when the peroxygen concentration is doubled, the surfactant by itself is more than twice as effective as before. Nevertheless, these results, relative to the application of surfactant and activator in combination, were even less effective than before. That is, the addition of activator directly to the bowl was much less effective for stain removal than addition to the fabric in combination with surfactant and required 2.5 to 3 times as much activator, relative to the peroxide, to reach the same degree of stain removal.

EXAMPLE III

A still further series of 27 tests was run in which several variables were observed. In Tests 45–56, the relative effectiveness of adding both surfactant and activator by coating the stained substrate was compared with adding them directly to the bowl. Furthermore, in Tests 45–48, the effectiveness of the system in wash water containing no detergent was determined. In Tests 57–59, the effect of adding activator alone to the wetted fabric was observed. In Tests 61–71, the use of several different types of surfactants was observed. The results of these tests are given in Table 3 below.

TABLE 3

Tergotometer ® Evaluation of Activators and Surfactants on Tea-Stained Fabrics

Test Conditions:

Peroxygen compound $H_2O_2$, 50 ppm, basis active oxygen, 49° C. water temperature, 10 minutes wash at 100 cpm, 1000 ml wash water containing 150 ppm $CaCO_3$ hardness.

| | Coating Composition | | | | | | | |
|---|---|---|---|---|---|---|---|---|
| Test No. | Surfactant | Activator | Wt. Ratio of Activator to Surfactant | Amount Applied (gms) | Applied to | Mole Ratio of Activator to $H_2O_2$ | Detergent in Wash Water (gms)[5] | % Stain Removal |
| 45 | Pluronic P-75[1] | Phthalic Anhydride | 1.0 | 0.23 | Fabric | 0.25 | None | 23.6 |
| 46 | " | " | 1.0 | 0.46 | " | 0.50 | None | 47.3 |
| 47 | " | " | 1.0 | 0.92 | " | 1.00 | None | 57.5 |
| 48 | " | None | 0.0 | 0.46 | " | 0.0 | None | 4.5 |
| 49 | " | Phthalic Anhydride | 1.0 | 0.23 | Bowl | 0.25 | 1.5 | 25.8 |
| 50 | " | " | 1.0 | 0.46 | " | 0.50 | " | 35.6 |
| 51 | " | " | 1.0 | 0.92 | " | 1.00 | " | 55.0 |
| 52 | " | None | 0.0 | 0.46 | " | 0.0 | " | 12.7 |
| 53 | " | Phthalic Anhydride | 0.33 | 0.46 | " | 0.25 | " | 24.3 |
| 54 | " | " | 0.33 | 0.92 | " | 0.50 | " | 34.3 |
| 55 | " | " | 0.33 | 1.84 | " | 1.00 | " | 52.0 |
| 56 | " | None | 0.0 | 0.92 | " | 0.0 | " | 9.1 |
| 57 | None | Phthalic Anhydride | ∞ | 0.115 | Wet Fabric | 0.25 | " | 35.3 |
| 58 | None | " | ∞ | 0.23 | " | 0.50 | " | 39.3 |
| 59 | None | " | ∞ | 0.46 | " | 1.00 | " | 59.3 |
| 60 | None | None | — | — | — | — | " | 12.9 |
| 61 | Pluronic P-123[2] | None | 0.0 | 0.92 | Fabric | 0.5 | " | 17.6 |
| 62 | Pluronic P-94[3] | Phthalic Anhydride | 0.33 | 0.92 | " | 0.5 | " | 52.7 |
| 63 | Pluronic P-104[4] | " | 0.33 | 0.92 | " | 0.5 | " | 52.7 |
| 64 | Pluronic P-123 | " | 0.33 | 0.92 | " | 0.5 | " | 59.3 |
| 65 | " | Cis-4-cyclohexane-1,2-dicarboxylic Anhydride | 0.33 | 0.95 | " | 0.5 | " | 58.7 |
| 66 | " | d-Camphoric Anhydride | 0.33 | 1.14 | " | 0.5 | " | 23.6 |
| 67 | " | Tetraacetylgly- | 0.33 | 1.94 | " | 0.5 | " | 64.2 |

-continued

| Test No. | Coating Composition: Surfactant | Activator | Wt. Ratio of Activator to Surfactant | Amount Applied (gms) | Applied to | Mole Ratio of Activator to $H_2O_2$ | Detergent in Wash Water (gms)[5] | % Stain Removal |
|---|---|---|---|---|---|---|---|---|
| | | coluril | | | | | | |
| 68 | " | Benzoic Anhydride | 0.33 | 1.42 | " | 0.5 | " | 73.9 |
| 69 | " | Glutaric Anhydride | 0.33 | 0.72 | " | 0.5 | " | 46.8 |
| 70 | " | Pyromellitic Di-Anhydride | 0.33 | 1.36 | " | 0.5 | " | 53.9 |
| 71 | " | Succinic Anhydride | 0.33 | 0.63 | " | 0.5 | " | 41.5 |

[1]HLB 16.5
[2]HLB 8.0
[3]HLB 13.5
[4]HLB 13.0
[5]Tide[200], Trade name of Procter & Gamble, Cincinnati, Ohio, for granular household laundry detergent.

A comparison of the results of Tests 45–48 with 49–52, reveals that the invention is almost as effective in wash-water systems which contain no detergent as it is with those that do. Without the use of activators in any form, the use of detergent in the wash water improved stain removal from 4.5 to only 12.7%. Using the coating composition of the invention in wash water without detergent produced stain removals no less than 23.6%. Furthermore, it is apparent that adding both surfactant and activator directly to the bowl with detergent was somewhat less effective than adding them by coating the substrate and then submerging the substrate in water containing no detergent.

Tests 57–59 illustrate that the application of activator to the moistened fabric is somewhat effective even without surfactant. Test 61 confirms that the use of surfactant without activator is relatively ineffective. Tests 64–71 illustrate the effectiveness of several different activators in the method of the invention.

EXAMPLE IV

The following series of five tests shows that the process of the invention is effective at quite low washwater temperatures (20° C.) as well as at more normal temperatures of 49° C. or higher. These results are found in Table 4 which follows.

TABLE 4

Tergotometer ® Evaluation of Activators and Surfactants On Tea-Stained Fabrics

Test Conditions:

Peroxygen compound $H_2O_2$, 50 ppm, basis active oxygen, 21° C. water temperature, 10 minutes wash at 100 cpm, 1.5 gms Tide ® (no phosphate) in 1000 ml water containing 150 ppm $CaCO_3$ hardness.

| Test No. | Coating Composition: Surfactant | Activator | Wt. Ratio of Activator to Surfactant | Amount Applied (grams) | Applied to | Mole Ratio of Activator to $H_2O_2$ | % Stain Removal |
|---|---|---|---|---|---|---|---|
| 72 | Pluronic P-123 | Phthalic Anhydride | 0.33 | 0.92 | Fabric | 0.5 | 34.7 |
| 73 | " | Tetraacetylglycoluril | 0.33 | 1.94 | " | 0.5 | 11.2 |
| 74 | " | Benzoic Anhydride | 0.33 | 1.42 | " | 0.5 | 44.4 |
| 75 | " | None | 0.0 | 0.92 | " | 0.0 | 2.8 |
| 76 | None | None | — | — | — | 0.0 | 6.6 |

EXAMPLE V

In the following Examples a number of washing tests were run at 18, 38 and 60° C., in a commercially available washing machine using a low water setting of 16.0 gallons.

TABLE 5

Washing Machine Evaulation of Activators and Surfactants On Tea-Stained Fabrics

Test Conditions:

Peroxygen Compound $H_2O_2$, 50 ppm, basis active oxygen, water temperature as shown in Table, 10 minutes wash time, 90 gms Tide ® (No phosphate) in water containing 150 ppm $CaCO_3$ hardness.

| Test No. | Coating Composition: Surfactant | Activator | Wt. Ratio of Activator to Surfactant | Amount Applied (gms) | Applied to | Mole Ratio of Activator to $H_2O_2$ | % Stain Removal | Wash Water Temperature ° C. |
|---|---|---|---|---|---|---|---|---|
| 77 | Pluronic P-123 | Phthalic Anhydride | 3 | 0.33 | Fabric | $8.9 \times 10^{-3}$ | 32.5 | 18 |
| 78 | " | " | 1 | 0.50 | " | $9.0 \times 10^{-3}$ | 34.7 | " |
| 79 | " | " | 0.33 | 1.0 | | " | 37.1 | " |
| 80 | " | " | 0.11 | 2.5 | " | " | 27.0 | " |
| 81 | " | Tetraacetylglycol-uril | 0.33 | 1.0 | " | $4.3 \times 10^{-3}$ | 4.7 | " |
| 82 | None | Phthalic Anhydride | ∞ | 0.25 | Wet Fabric | $9.0 \times 10^{-3}$ | 10.8 | " |
| 83 | None | Tetraacetylglycol-uril | ∞ | 0.25 | " | $4.3 \times 10^{-3}$ | 6.0 | " |
| 84 | Pluronic P-123 | None | 0.0 | 0.75 | Fabric | 0.0 | 5.8 | " |
| 85 | None | None | — | — | — | — | 2.1 | " |
| 86 | Pluronic P-123 | Phthalic Anhydride | 3 | 1.0 | Fabric | $9.0 \times 10^{-3}$ | 48.9 | 38 |
| 87 | " | None | 0.0 | 1.0 | " | 0.0 | 19.2 | " |
| 88 | None | Phthalic Anhydride | ∞ | 0.25 | Wet Fabric | $9.0 \times 10^{-3}$ | 25.6 | " |

-continued

| Test No. | Coating Composition: Surfactant | Activator | Wt. Ratio of Activator to Surfactant | Amount Applied (gms) | Applied to | Mole Ratio of Activator to $H_2O_2$ | % Stain Removal | Wash Water Temperature ° C. |
|---|---|---|---|---|---|---|---|---|
| 89 | Polystik | " | 0.33 | 0.46 | Fabric | $4.1 \times 10^{-3}$ | 69.2 | 60 |
| 90 | " | " | 0.33 | 0.92 | " | $8.3 \times 10^{-3}$ | 65.8 | " |
| 91 | " | None | 0.0 | 0.92 | " | 0.0 | 49.4 | " |
| 92 | None | None | — | — | — | 0.0 | 53.0 | " |

The above data do, of course, show that the problem of stain removal is alleviated by the use of higher wash temperatures. Thus, surfactant alone is on the order of 80% as effective as surfactant/activator coatings at 60° C. However, surfactant alone is less than 20% as effective as surfactant/activator coatings at 18° C.

EXAMPLE VI

In the following Examples ten washing tests were run at 54.5° C. in a commercially available washing machine using a low water setting of 16.0 gallons. The data in Table 6 below illustrate the effectiveness of the method of the invention for reducing grape stains.

TABLE 6

Washing Machine Evaluation of Activators and Surfactants On Grape-Stained Fabric Test Conditions:

Peroxygen Compound $H_2O_2$, 50 ppm, basis active oxygen, water temperature as shown in Table, 10 minutes wash time, 90 gms Tide ® (no phosphate) in water containing 150 ppm $CaCO_3$ hardness.

| Test No. | Coating Composition: Surfactant | Activator | Wt. Ratio of Activator to Surfactant | Amount Applied (gms) | Applied to | Mole Ratio of Activator to $H_2O_2$ | % Stain Removal | Wash Water Temperature ° C. |
|---|---|---|---|---|---|---|---|---|
| 93 | None | None | — | — | — | — | 14.0 | 54.5 |
| 94 | Pluronic P-75 | " | 0.0 | 0.75 | Fabric | 0.0 | 19.3 | " |
| 95 | Pluronic P-94 | " | " | " | " | " | 17.5 | " |
| 96 | Pluronic P-104 | " | " | " | " | " | 18.3 | " |
| 97 | Pluronic P-123 | " | " | " | " | " | 17.4 | " |
| 98 | Pluronic P-75 | Phthalic Anhydride | 0.33 | 1.0 | " | $9.0 \times 10^{-3}$ | 31.0 | " |
| 99 | Pluronic P-94 | " | " | " | " | " | 30.9 | " |
| 100 | P-104 | " | " | " | " | " | 26.9 | " |
| 101 | P-123 | " | " | " | " | " | 26.5 | " |
| 102 | None | " | ∞ | 0.25 | Wet Fabric | " | 17.7 | " |

EXAMPLE VII

The following series of tests show that the process of the invention is effective in wash liquors containing 1.5 grams/liter of a phosphate-built detergent. In addition, the results of Test 123 show that the effectiveness of the coating composition was not adversely affected by extended storage (46 days). Runs were made at 17, 35, 37 and 54.5° C. in a commercially available washing machine using a low water setting of 16.0 gallons.

TABLE 7

Washing Machine Evaluation of Activators and Surfactants On Tea-Stained Fabrics

Test Conditions:

Peroxygen compound $H_2O_2$, 50 ppm, basis active oxygen, water temperature as shown in Table, 10 minutes wash time, 90 gms Cheer ® (8.7% phosphorus)[1] in water containing 150 ppm $CaCO_3$ hardness.

[1] Cheer ®, Trade name of Procter & Gamble, Cincinnati, Ohio, for granular household laundry detergent.

| Test No. | Coating Composition: Surfactant | Activator | Wt. Ratio of Activator to Surfactant | Amount Applied (gms) | Applied to | Mole Ratio of Activator to $H_2O_2$ | % Stain Removal | Wash Water Temperature ° C. |
|---|---|---|---|---|---|---|---|---|
| 103 | None | None | — | — | — | — | 10.3 | 17 |
| 104 | Pluronic P-123 | None | 0.0 | 1.0 | Fabric | 0.0 | 12.9 | " |
| 105 | " | Tetraacetylglycoluril | 0.33 | 1.33 | " | $5.7 \times 10^{-3}$ | 12.6 | " |
| 106 | " | " | " | 2.66 | " | $1.1 \times 10^{-2}$ | 11.1 | " |
| 107 | " | Benzoic Anhydride | " | 1.55 | " | $9.0 \times 10^{-3}$ | 32.4 | " |
| 108 | " | Phthalic Anydride | " | 1.00 | " | $9.0 \times 10^{-3}$ | 34.7 | " |
| 109 | None | None | — | — | — | — | 14.6 | 37 |
| 110 | Pluronic P-123 | None | 0.0 | 1.0 | Fabric | 0.0 | 18.8 | " |
| 111 | " | Tetraacetylglycoluril | 0.33 | 1.33 | " | $5.7 \times 10^{-3}$ | 17.7 | " |
| 112 | " | " | " | 2.66 | " | $1.1 \times 10^{-2}$ | 15.3 | " |
| 113 | " | Benzoic Anhydride | 0.33 | 1.55 | " | $9.0 \times 10^{-3}$ | 39.5 | " |
| 114 | " | Phthalic Anydride | " | 1.0 | " | $9.0 \times 10^{-3}$ | 43.8 | " |
| 115 | None | None | — | — | — | — | 22.5 | 54.5 |
| 116 | Pluronic P-123 | None | 0.0 | 1.0 | Fabric | 0.0 | 25.5 | " |
| 117 | " | Tetraacetylglycoluril | 0.33 | 1.33 | " | $5.7 \times 10^{-3}$ | 26.8 | " |
| 118 | " | " | " | 2.66 | " | $1.1 \times 10^{-1}$ | 25.5 | " |
| 119 | " | Benzoic Anhydride | " | 1.55 | " | $9.0 \times 10^{-3}$ | 46.4 | " |
| 120 | " | Phthalic Anhydride | " | 1.00 | " | $9.0 \times 10^{-3}$ | 48.4 | " |
| 121 | None | None | — | — | — | — | 12.0 | 35 |
| 122 | Pluronic P-123 | None | 0.0 | 0.75 | Fabric | 0.0 | 14.3 | " |

-continued

| Test No. | Coating Composition: Surfactant | Activator | Wt. Ratio of Activator to Surfactant | Amount Applied (gms) | Applied to | Mole Ratio of Activator to $H_2O_2$ | % Stain Removal | Wash Water Temperature °C. |
|---|---|---|---|---|---|---|---|---|
| 123 | " | Phthalic Anhydride | 0.33 | 1.00 | " | $9.0 \times 10^{-3}$ | 44.1 | " |

EXAMPLE VIII

The following tests show application of the process of the invention using active oxygen derived by activation of sodium perborate tetrahydrate and sodium percarbonate. Runs were made at 34.5° C. in a commercially available washing machine using a warm wash-/cold rinse and a low water setting of 16.0 gallons.

TABLE 8

Washing Machine Evaluation of Activators and Surfactants On Tea-Stained Fabrics

Test Conditions:

Active oxygen 50 ppm, 34.5° C. water temperature, 10 minutes wash time, 90 gms Tide® (6.1% phosphorus) in water containing 150 ppm $CaCO_3$ hardness.

| Test No. | Coating Composition: Surfactant | Activator | Wt. Ratio of Activator to Surfactant | Amount Applied (gms) | Applied to | MOle Ratio of Activator to $H_2O_2$ | Peroxygen Compound | % Stain Removal |
|---|---|---|---|---|---|---|---|---|
| 124 | None | None | — | — | — | — | Sodium Perborate | 10.6 |
| 125 | Pluronic P-123 | None | 0.0 | 0.75 | Fabric | 0.0 | " | 12.8 |
| 126 | " | Phthalic Anhydride | 0.33 | 1.00 | " | $9.0 \times 10^{-3}$ | " | 38.4 |
| 127 | None | None | — | — | — | — | Sodium Percarbonate | 13.3 |
| 128 | Pluronic P-123 | None | 0.0 | 0.75 | Fabric | 0.0 | " | 12.6 |
| 129 | " | Phthalic Anhydride | 0.33 | 1.00 | " | $9.0 \times 10^{-3}$ | " | 39.7 |

What is claimed is:

1. A method for treating the surface of a textile fabric oxidatively using activated peroxygen compounds comprising
   (1) coating at least one stained area on the surface with an adherent layer of a viscous water-soluble composition comprising
      (a) a peroxide activator dispersed in
      (b) a nonionic surfactant having an HLB number below about 30, the weight ratio of activator to surfactant in the composition being from about 1:10 to about 10:1; and
   (2) immersing the coated fabric in water containing at least 5 ppm by weight, basis active oxygen, of peroxygen compound until the layer of viscous composition has disintegrated.

2. The method of claim 1 wherein the activator is an organic acid anhydride.

3. The method of claim 2 wherein the nonionic surfactant has an HLB number between about 9 and about 16, and the ratio of activator to surfactant is from about 1:5 to about 5:1.

4. The method of claim 3 wherein the organic acid anhydride is phthalic anhydride or benzoic anhydride.

5. The method of claim 1 wherein the water-soluble composition is in the form of a shaped solid in which the surfactant constitutes the continuous phase.

6. The method of claim 1 in which the peroxygen compound is added to the water as alkali metal perborate, percarbonate, perphosphate, persilicate, perpyrophosphate, peroxide, hydrogen peroxide or mixtures thereof.

7. The method of claim 1 in which the temperature of the water is below about 70° C.

8. A viscous anhydrous water-soluble composition for preparing the surface of a textile fabric for oxidative treatment with activated peroxygen compound dispersed in water comprising
   (a) a peroxide activator dispersed in
   (b) a nonionic, water-soluble surfactant having an HLB number below about 30, the weight ratio of activator to surfactant in the composition being from about 1:10 to about 10:1.

9. The composition of claim 8 wherein the activator is an organic acid anhydride.

10. The composition of claim 9 wherein the non-ionic surfactant has an HLB number between about 9 and about 16, and the ratio of activator to surfactant is from about 1:15 to about 5:1.

11. The composition of claim 10 wherein the organic acid anhydride is phthalic anhydride or benzoic anhydride.

* * * * *